US005732685A

United States Patent [19]

Nakamura

[11] Patent Number: 5,732,685

[45] Date of Patent: Mar. 31, 1998

[54] FUEL SUPPLY SYSTEM FOR WATERCRAFT

[75] Inventor: Mitsuyoshi Nakamura, Iwata, Japan

[73] Assignee: Yamaha Hatsudoki Kabushiki Kaisha, Iwata, Japan

[21] Appl. No.: 715,856

[22] Filed: Sep. 20, 1996

[30] Foreign Application Priority Data

Sep. 22, 1995 [JP] Japan ..... 7-269073

[51] Int. Cl.[6] ..... F02M 37/00

[52] U.S. Cl. ..... 123/514; 123/468; 123/509

[58] Field of Search ..... 123/468, 469, 123/470, 456, 452, 73 C, 73 CC, 514, 73 AF, 509

[56] References Cited

U.S. PATENT DOCUMENTS

| | | | |
|---|---|---|---|
| 5,022,355 | 6/1991 | Billingsley et al. | 123/73 A |
| 5,197,436 | 3/1993 | Ozawa | 123/468 |
| 5,241,931 | 9/1993 | Radel | 123/514 |
| 5,259,352 | 11/1993 | Gerhardy et al. | 123/73 C |
| 5,367,998 | 11/1994 | Shiohara et al. | 123/457 |
| 5,429,095 | 7/1995 | Aodai et al. | 123/514 |

*Primary Examiner*—Thomas N. Moulis

*Attorney, Agent, or Firm*—Knobbe, Martens, Olson & Bear, LLP

[57] ABSTRACT

An improved fuel supply system for a watercraft engine eases the setting of fuel supply pressure in each of the carburetors of the engine. The fuel supply system includes a fuel supply line which supplies fuel to a plurality of feed branches of the fuel circuit which are arranged in parallel. Each branch communicates with one of the carburetors. The branches have equal lengths such that the flow resistance within each branch is generally the same between the branches. The fuel supply system also includes a fuel return line which communicates with a plurality of return branches of the fuel circuit. The return branches are arranged in parallel, with each return branch communicating with one of the carburetors. The return branches also have equal lengths and are arranged to have like flow resistances. This structure of the fuel circuit between the carburetors tends to isolate the carburetors from one another such that the fuel pressure in one carburetor does not affect the fuel pressure in the other carburetors. As a result, setting the fuel supply pressure of each carburetor is eased in comparison to prior fuel circuits where the carburetors are arranged in series within the fuel circuit.

20 Claims, 6 Drawing Sheets

FUEL SUPPLY SYSTEM FOR WATERCRAFT

BACKGROUND OF THE INVENTION

1. Field of the Invention

The present invention relates to an engine for a small watercraft, and in particular to a fuel delivery system for a watercraft engine.

2. Description of Related Art

Personal watercrafts have become popular in recent years. This type of watercraft is quite sporting in nature and is designed to carry a rider and possibly one or two passengers. A relatively small hull of the personal watercraft commonly defines a rider's area above an engine compartment.

An internal combustion engine frequently powers a jet propulsion unit which propels the watercraft. The engine lies within the engine compartment in front of a tunnel formed on the underside of the watercraft hull. The jet propulsion unit is located within the tunnel and is driven by a drive shaft. The drive shaft commonly extends between the engine and the jet propulsion device, through a wall of the hull that forms a front gullet portion of the tunnel.

Personal watercrafts often employ an in-line, multi-cylinder, crankcase compression, two-cycle engine, usually including two or three cylinders. The engine conventionally lies within the engine compartment with the in-line cylinders aligned along a longitudinal axis of watercraft hull (in the bow-stem direction).

A dedicated carburetor usually supplies fuel to each cylinder of the engine. Because of the sporting nature of the watercraft and the tendency for frequent, abrupt directional changes of the watercraft when used, the engine desirably employs floatless-type carburetors. A fuel system used with the floatless-type carburetors continuously supplies fuel from the fuel tank to the carburetors while returning excess fuel to the fuel tank.

Prior fuel supply systems supply fuel to the carburetors in succession. That is, the carburetors are arranged in series. Fuel is supplied from one carburetor to the next and the excess fuel from the last carburetor is returned to the fuel tank. Although prior fuel systems have effectively supplied fuel to the carburetors, technicians often find it difficult to set the fuel supply pressure for each individual carburetor within the series.

SUMMARY OF THE INVENTION

The serial arrangement of the carburetors in the fuel system causes the fuel pressure in upstream carburetors to affect the fuel pressure of downstream carburetors, which consequently complicates the setting of fuel supply pressure for each carburetor. A need therefore exists for an fuel supply system which eases the setting of fuel supply pressure for each carburetor.

Thus, one aspect of the present invention involves a fuel circuit for an engine of a small watercraft. The fuel circuit comprises a fuel supply line which communicates with a fuel source and extends into a plurality of parallel fuel circuit branches. A fuel return line communicates with each of the branches to return excess fuel to the fuel source. A plurality of charge formers are arranged in parallel, with each charge former being positioned in one of the branches.

Another aspect of the present invention involves a multi-cylinder engine for a marine watercraft. The engine comprises an engine block assembly which includes a plurality of variable-volume chambers. An induction system is positioned on the side of the engine block assembly and includes a plurality of charge formers. Each of the charge formers communicates with one of the variable-volume chambers. A fuel circuit comprises a fuel supply line and a fuel return line. The fuel supply and returns lines separately communicate with each charger former, independent from the other charge formers.

In accordance with an additional aspect of the present invention, an engine comprises an engine block which includes at least one variable-volume chamber. A charge former communicates with the variable-volume chamber, and a fuel pump supplies fuel to the charge former. The fuel pump is driven by pressure changes occurring within the variable-volume chamber and is located on a side of the charge former opposite the engine block.

BRIEF DESCRIPTION OF THE DRAWINGS

These and other features of the invention will now be described with reference to the drawings of a preferred embodiment, which is intended to illustrate and not to limit the invention, and in which.

DETAILED DESCRIPTION OF THE PREFERRED EMBODIMENT

Figure 1:
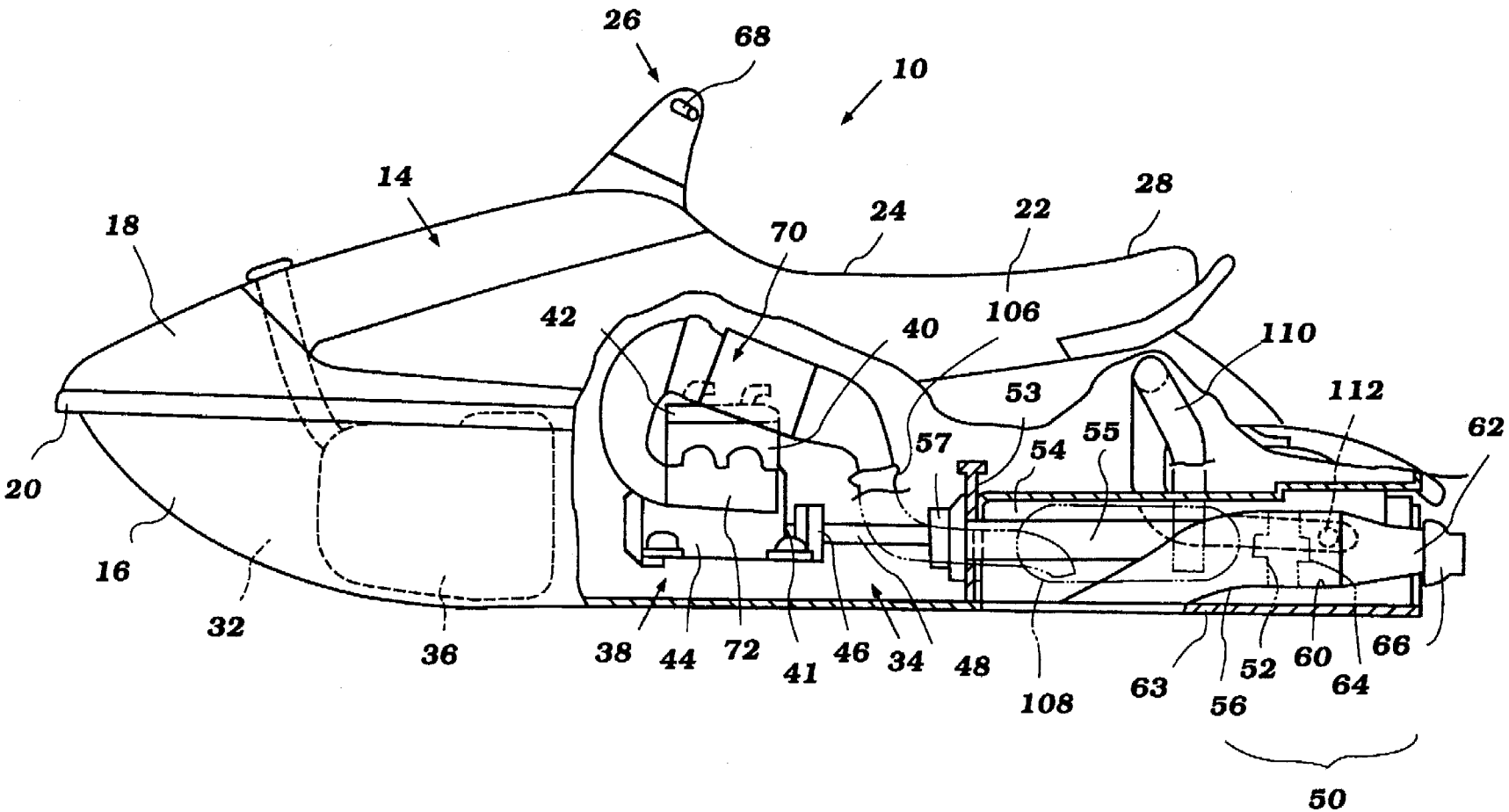
FIG. 1 is a partial sectional, side elevational view of a personal watercraft which employs a fuel supply system configured in accordance with a preferred embodiment of the present invention.

FIG. 1 illustrates a personal watercraft 10 which includes a fuel supply system configured in accordance with a preferred embodiment of the present invention. Although the present fuel supply system is illustrated in connection with an engine for a personal watercraft, the fuel supply system can be used with other types of watercraft as well, such as, for example, but without limitation, small jet boats and the like.

Before describing the fuel supply system, an exemplary personal watercraft 10 will first be described in general details to assist the reader's understanding of the environment of use and the operation of the fuel supply system. The watercraft 10 includes a hull 14 formed by a lower hull section 16 and an upper deck section 18. The hull sections 16, 18 are formed from a suitable material such as, for example, a molded fiberglass reinforced resin. The lower hull section 16 and the upper deck section 18 are fixed to each other around the peripheral edges 20 in any suitable manner.

A passenger seat 22 is provided proximate to the stem of the hull 14. The passenger seat 22 is mounted longitudinally along the center of the watercraft 10. In the illustrated embodiment, the seat 22 has a longitudinally extended straddle-type shape which may be straddled by an operator and by at least one or two passengers. A forward end 24 of the seat 22 lies proximate to the controls 26 of the watercraft 10 which generally lie at about the longitudinal center of the watercraft 10. This position of the operator on the watercraft 10 gives the watercraft fore and aft balance when the operator rides alone. A rear portion 28 of the seat 22 is configured to allow one or two passengers to be comfortably seated behind the operator of the watercraft 10. The seat 22 desirably includes a removable seat cushion to increase the comfort of the operator and the passengers.

The upper deck section 18 of the hull 14 advantageously includes foot areas. The foot areas extend generally longitudinally and parallel to the sides of the elongated seat 22 so that the operator and any passengers sitting on the seat 22 can place their feet in the foot areas. A non-slip surface (not shown) is located in the foot areas to provide increased grip and traction for the operator and the passengers.

The lower hull section 16 of the personal watercraft 10 includes a forward compartment 32 and a rear compartment 34. In the exemplary watercraft depicted in FIG. 1, a fuel tank 36 and a buoyant block (not illustrated) are located in the forward compartment 32. The buoyant block affords additional buoyancy to the watercraft 10.

An internal combustion engine 38 powers the watercraft 10. The engine 38 is contained within the rear compartment 34 and is mounted primarily beneath the forward portion of the seat 22. Vibration-absorbing engine mounts 39 (see FIG. 2) secure the engine 38 to the hull lower portion 16 in a known manner. The engine 38 is mounted in approximately a central position in the watercraft 10.

In the illustrated embodiment, the engine 38 includes two in-line cylinders and operates on a two-stroke crankcase compression principle. The engine 38 is positioned such that the row cylinders lies parallel to a longitudinal axis of the watercraft 10, running from bow to stem. This engine type, however, is merely exemplary. Those skilled in the art will readily appreciate that the present exhaust pipe cooling system can be used with any of a variety of engine types having other number of cylinders, having other cylinder arrangements and operating on other combustion principles (e.g., four-stroke principle).

A cylinder block 40 and a cylinder head assembly 42 desirably form the cylinders of the engine 38. Pistons reciprocate within the engine 38 and drive an output shaft, such as a crankshaft 41, in a known manner. The corresponding cylinder bore, piston and cylinder head of each cylinder forms a variable-volume chamber, which at a minimum volume defines a combustion chamber.

The engine 38 also includes cooling jackets that extends through cylinder block 40, about the cylinders, and through the cylinder head assembly 42. The cylinder head 42 includes a pair of coolant discharge ports 43, 45 (see FIG. 3) through which the cooling water exits the engine 38, as described below.

The crankshaft 41 desirably is journaled with a crankcase 44, which in the illustrated embodiment is located beneath the cylinder block 40. Crankcase chambers of the engine 38 are sealed from one another with each crankcase chamber communicating with a dedicated variable-volume chamber. Each crankcase chamber also communicates with a charge former of an induction system (which is described below in detail) through a check valve (e.g., a reed-type valve). Because the internal details of the engine 38 desirably are conventional, a further description of the engine construction is not believed necessary to understand and practice the invention.

As seen in FIG. 1, a coupling 46 interconnects the engine crankshaft to an impeller shaft 48. If the engine output shaft is vertically disposed, the impeller shaft 48 will be driven through a bevel gear transmission or a similar transmission. The propeller shaft 48 extends rearwardly through a bulkhead 53, and a protective sleeve 55, to a jet propulsion unit 50 and drives an impeller 52 of the unit 50. A bearing assembly 57, which is secured to the bulkhead 53, supports the impeller shaft 52 behind the shaft coupling 46.

The jet propulsion unit 50 is positioned in a tunnel 54 in the rear center of the lower hull section 16 located behind the bulkhead 53. The propulsion unit 50 includes a gullet 56 having an inlet opening 58 formed on the bottom side of the lower hull section 16. The gullet 56 extends from the inlet opening 58 to a pressurization chamber 60. The pressurization chamber 60 in turn communicates with a nozzle section 62 of the propulsion unit 50. A ride plate 63 covers a portion of the tunnel 54 behind the gullet inlet 58 to enclose the pressurization chamber 60 and the nozzle 62 within the tunnel 54. In this manner, the lower opening of the tunnel 54 is closed by the front edge of the pump gullet 56 and the ride plate 63.

The impeller 52 is located toward the front end of the chamber 60. A central support 64 supports the rear end of the impeller shaft 48 behind the impeller 52 and generally at the center of the pressurization chamber 60. A bearing assembly (not shown) journals the rear end of the impeller shaft 48 within the support 64.

The rotating impeller 52, which the impeller shaft 48 drives, pressurizes the water within the chamber 60 and forces the pressurized water through the nozzle section 62 of the propulsion unit 50. A steering nozzle 66 directs the exit direction of the water stream exiting the jet propulsion unit 50. The steering nozzle 66 is pivotally supported at the rear of the jet propulsion unit 50 to change the thrust angle on the watercraft 10 for steering purposes as is known in the art.

The steering nozzle 66 is connected to a steering handle 68. The steering handle 68 forms part of the operator controls 26 which are mounted in front of the operator seat 22 as noted above. The steering handle 68 also can include a throttle control for controlling the speed of the engine.

The personal watercraft 10 so far described is conventional and represents only an exemplary watercraft on which the present fuel supply system can be employed. A further description of the personal watercraft 10 therefore is not believed necessary for an understanding and an appreciation of the present invention. Exhaust and cooling systems, which are desirably used with the engine 38, will now be described in detail, followed by a detailed description of the present fuel supply system.

Figure 2:
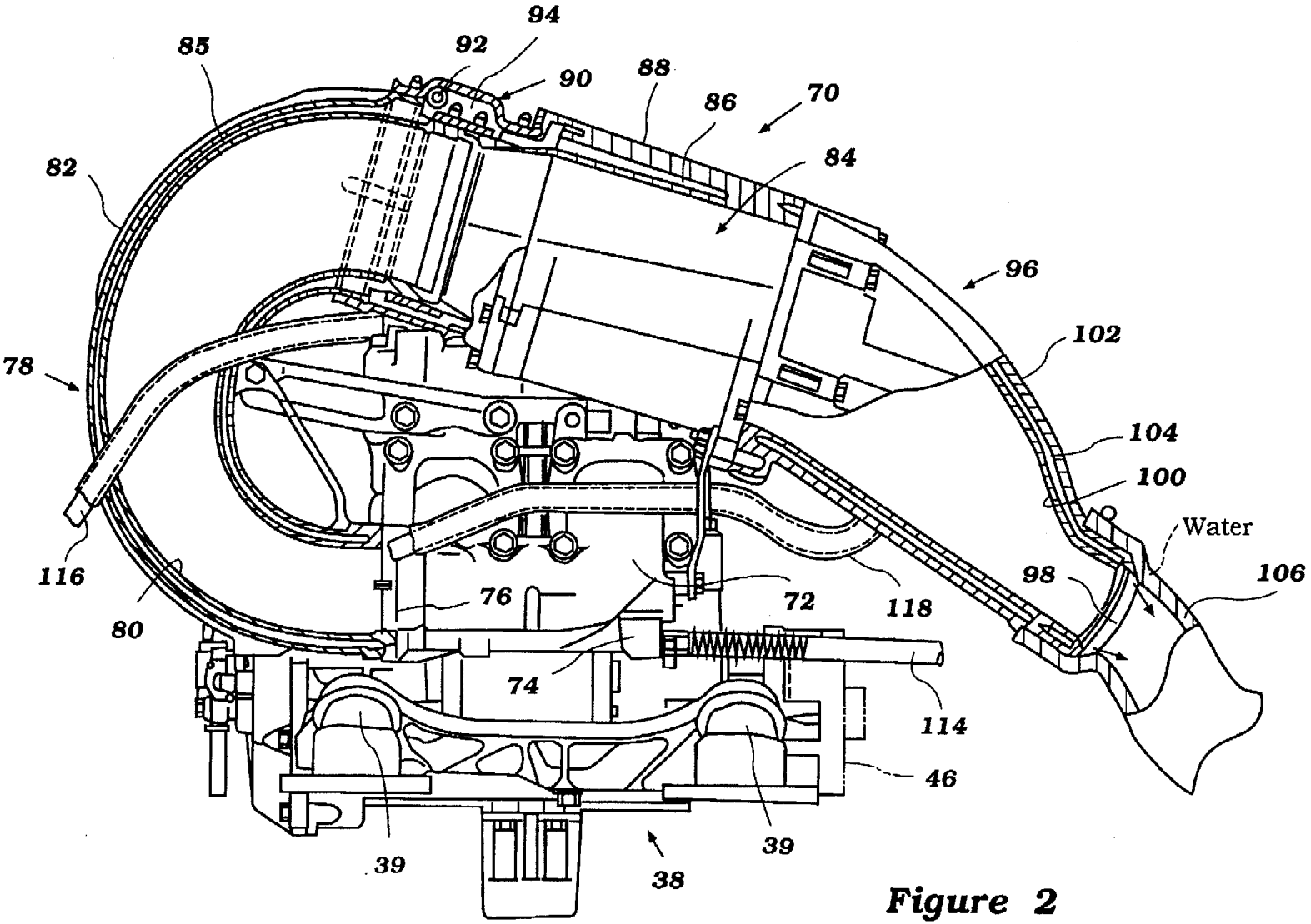
FIG. 2 is a partial, sectional side elevational view of an engine of the watercraft of FIG. 1, illustrating a portion of an exhaust system in section.
Figure 3:
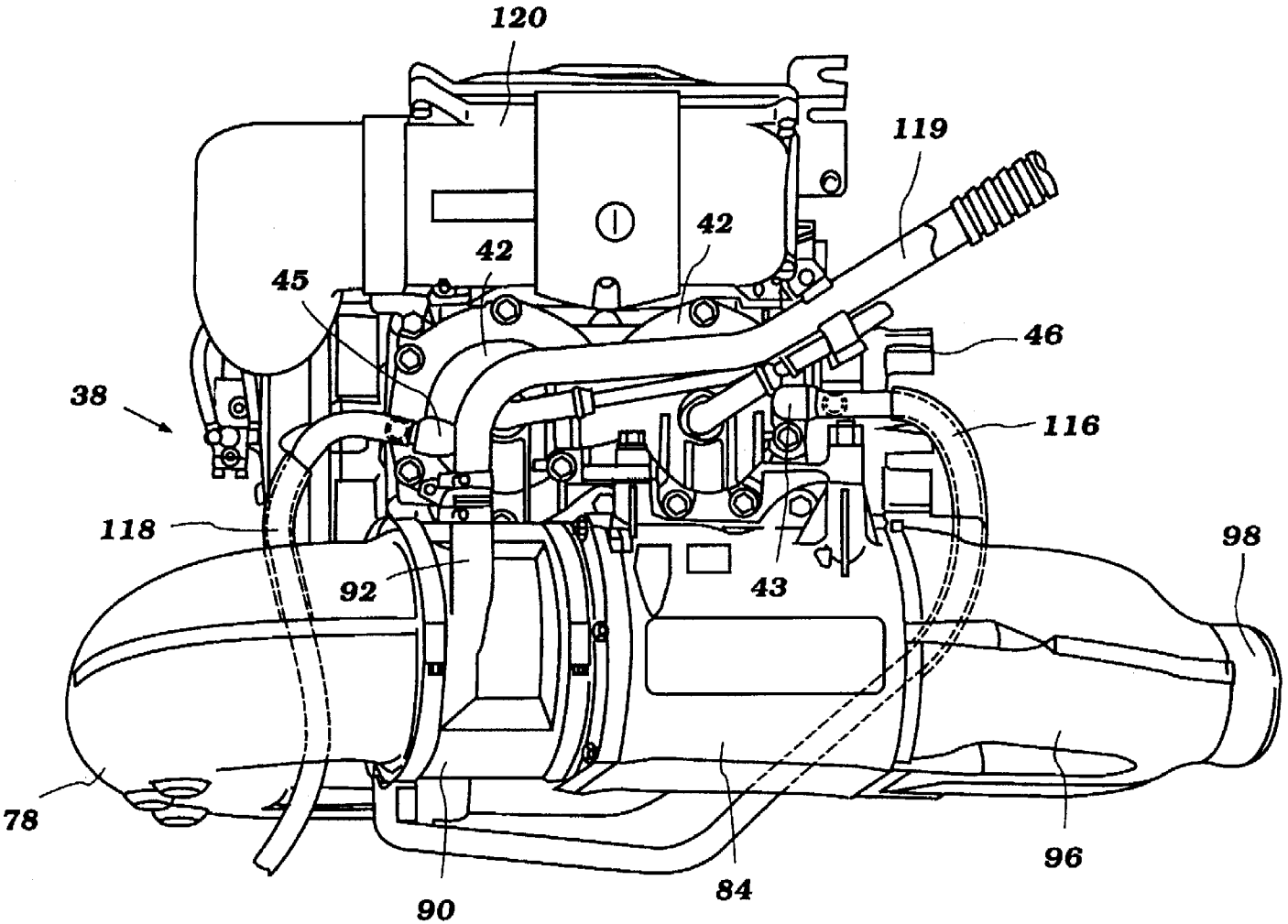
FIG. 3 is a top plan view of the engine of FIG. 2.

With reference to FIGS. 1 through 3, an exhaust system 70 is provided to discharge exhaust byproducts from the engine 38 to the atmosphere and/or to the body of water in which the watercraft 10 is operated. The exhaust system 70 includes an exhaust manifold 72 that is affixed to the side of the cylinder block 40 and which receives exhaust gases from the variable-volume chambers through exhaust ports in a well-known manner.

The exhaust manifold 72 includes a plurality of coolant jacket passages which extend around the exhaust conduits formed within the manifold 72. An inlet port 74 is formed at the lower, rear end of the manifold 72 and communicates with at least some of the internal water jacket passages within the exhaust manifold 72.

An outlet end 76 of the exhaust manifold 72 communicates with a C-shaped pipe section 78. This C-pipe 78 includes an inner tube 80 that communicates directly with the discharge end 76 of the exhaust manifold 72. An outer tube 82 surrounds the inner tube 80 to form a coolant jacket 85 between the inner and outer tubes 80, 82. Although not illustrated, the C-pipe 78 includes an inlet port positioned near its inlet end. The inlet port communicates with the coolant jacket 85.

The outlet end of the C-pipe 78 communicates with an expansion chamber 84. In the illustrated embodiment, the expansion chamber 84 has a tubular shape in which an expansion volume is defined within an annular, thick wall 86. Coolant jacket passages 88 extend through the expansion chamber wall 86 and communicate with the coolant jacket 85 of the C-pipe 78.

A flexible coupling 90 connects the outlet end of the C-pipe 78 to the inlet end of the expansion chamber 84. The flexible coupling also includes an outlet port 92 which communicates with an internal coolant passage 94 within the flexible coupling 90. The coolant passage 94 places the coolant jacket 85 and the coolant passages 88 in communication.

The outlet end of the expansion chamber 84 is fixed to reducer pipe 96 which tapers in diameter toward its outlet 98. The pipe 96 has a dual shell construction formed by an inner shell 100 which defines an exhaust flow passage. The expansion volume communicates with this passage.

An outer shell 102 is connected to the inner shell 100 and defines a cooling jacket 104 about the inner shell 100. The coolant jacket passages 88 of the expansion chamber 84 communicate with the coolant jacket 104 of the pipe 96 to discharge a portion of the coolant with the exhaust gases.

Although not illustrated, a catalyzer can be disposed within the space defined at the mating ends of the expansion chamber 84 and the reducer pipe 96. For instance, the catalyzer can include an annular shell supporting a honeycomb-type catalyst bed. The catalyst bed is formed of a suitable catalytic material such as that designed to treat and render harmless hydrocarbons, carbon monoxide, and oxides of nitrogen. An annular flange supports the annular shell generally at the center of the flow path through the expansion chamber volume. In this manner, all exhaust gas flow through the expansion chamber 84 passes through the catalyst bed. The annular flange can be held between outlet end of the expansion chamber 84 and the inlet end of the reducer pipe 96.

The lower section of the reducer pipe 96 includes a downwardly turned portion that terminates at the discharge end 98. The inner shell 100 stops short of the outer shell 102 such that the water flow through the water jacket 104 merges with the exhaust gas flow through the exhaust passage at the discharge end 98.

A flexible pipe 106 is connected to the discharge end 98 of the reducer pipe 96 and extends rearwardly along one side of the watercraft hull runnel 54. The flexible conduit 106 connects to an inlet section of a water trap device 108. The water trap device 108 also lies within the watercraft hull 16 on the same side of the tunnel 54.

The water trap device 108 has a sufficient volume to retain water and to preclude the back flow of water to the expansion chamber 84 and the engine 38. Internal baffles within the water trap device 108 help control water flow through the exhaust system 70.

An exhaust pipe 110 extends from an outlet section of the water trap device 108 and wraps over the top of the tunnel 54 to a discharge end 112. The discharge end 112 desirably opens into the tunnel 54 at an area that is close to or actually below the water level with the watercraft 10 floating at rest on the body of water.

An engine and exhaust cooling system is formed in part by the coolant passages and jackets described above. The cooling system supplies fresh cooling water to the inlet port 74 of the exhaust manifold 72. In the illustrated embodiment, the propulsion unit 50 supplies cooling water through a conduit 114 to an exhaust manifold cooling jacket.

The cooling water passing through the exhaust manifold 72 flows into the cooling passages within the engine 38. The cooling water is then discharged through one of the two ports 43, 45 on the cylinder head 42. A small amount of the cooling water passes through telltale line 116. As telltale water, the water is discharged from a plate on the port side of the watercraft 10 in a position visible to the rider.

The majority of the cooling water flows through the first port 43 and into a conduit 118 which delivers the cooling water to water jackets surrounding the exhaust pipe sections 78, 84, 96. The conduit 118 connects to the inlet port (not shown) of the C-pipe 78, located near the outlet end 76 of the exhaust manifold 72. The cooling water flow through the coolant jacket 85 of the of the C-pipe 78 and into the coolant passage 94 of the flexible coupling 90.

A portion of the cooling water is discharged through the outlet port 92 because too much cooling water in the exhaust stream tends to cause flow resistance. A conduit 119 carries the cooling water that is discharged through the outlet port 94 to the outlet end 112 of the exhaust pipe 110.

The balance of the cooling water flows through the jackets within the expansion chamber 84 and the reducer pipe 86. The cooling water merges into the exhaust gas stream at the discharge end 98 of the pipe 96, and flow into the flexible hose 106 toward the water trap 108. The cooling water is eventually discharged with the exhaust gases through the outlet end 112 of the exhaust pipe 110.

An induction system is located on a side of the engine 38 opposite of the exhaust system 70 and supplies a fuel/air charge to the variable-volume chamber. In the illustrated embodiment, the induction system includes an air intake silencer 120. The silencer 120 is located above the engine 38 and includes a downwardly-facing inlet opening 122 (see FIG. 4). The inlet opening 122 opens into at least one plenum chamber within the silencer 120.

The plenum chamber of the silencer 120 communicates with a plurality of charge formers 124. The engine 38 desirably includes a number of charger formers 124 equal to the number of cylinders of the engine 38.

In the illustrated embodiment, the charger formers 124 are floatless-type carburetors; however, it is understood that other types of charge formers, such as, for example, fuel injectors, can also be used with the engine.

Figure 4:
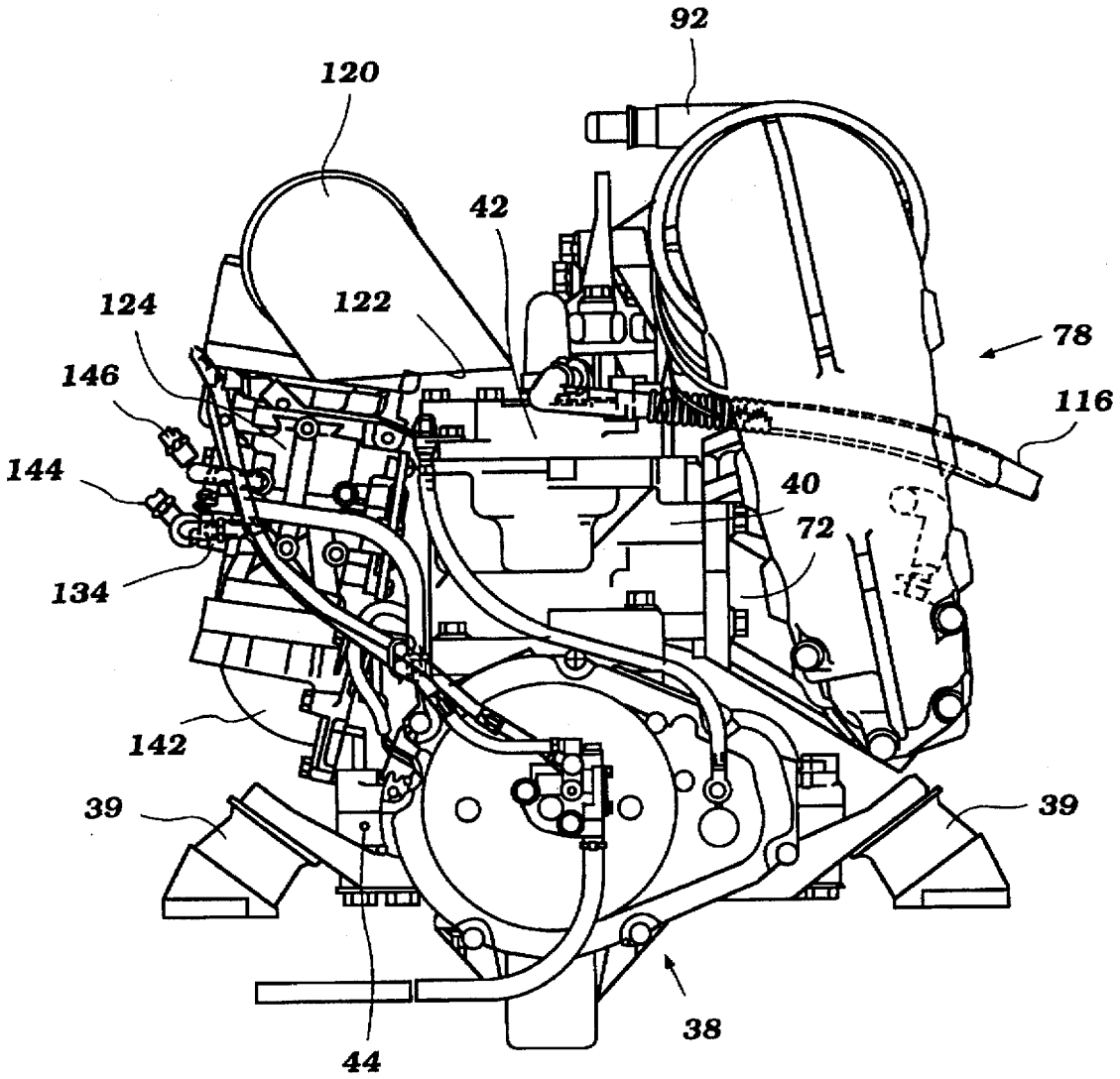
FIG. 4 is a front elevational view of the engine of FIG. 2.
Figure 5:
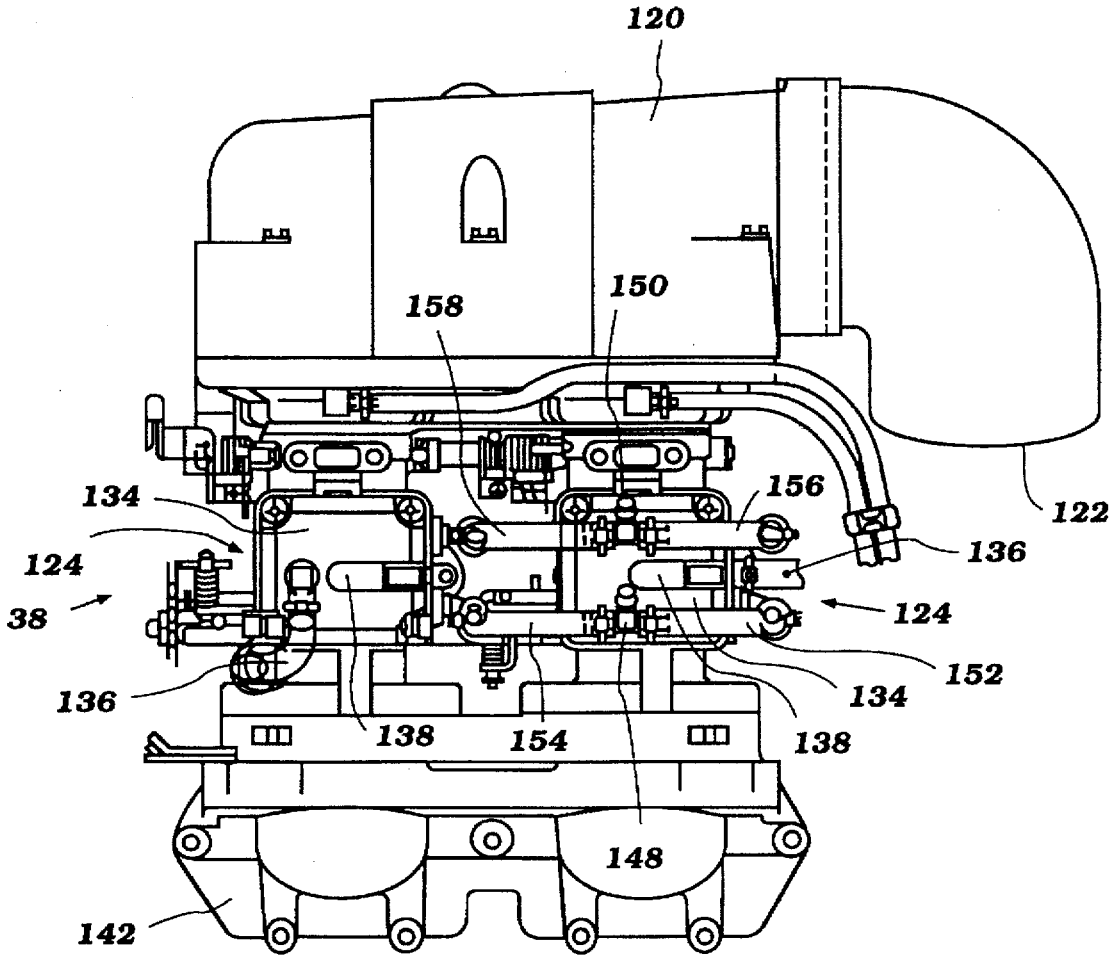
FIG. 5 is a side elevational view of an induction system of the engine of FIG. 3 and a portion of the fuel supply system used with the induction system.
Figure 6:
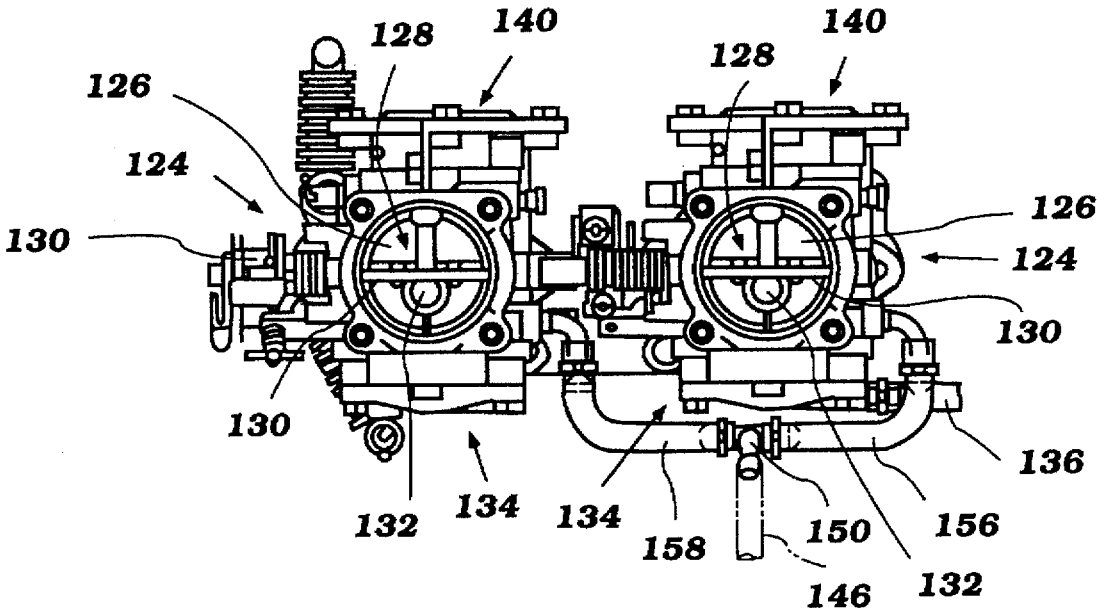
FIG. 6 is a top plan view of a portion of the fuel supply system and a pair of carburetors of the induction system of FIG. 5 with an inlet air silencer removed.

With reference to FIGS. 4 through 6, each carburetor 124 includes a throat 126 in which a throttle valve 128 is disposed. A common throttle shaft 130 supports the throttle valves 128 in the respective carburetor throats 126 and operates the throttle valves 128 in unison. The throttle shaft 130 is coupled to a throttle operator in a known manner.

A venturi 132 is located upstream of the throttle valve 128 within the carburetor throat 126. A floatless fuel metering device supplies fuel to a fuel opening within the venturi 132. The air flow through the venturi 132 draws the fuel through the hole to form the fuel/air charge delivered to the combustion chambers.

The floatless fuel metering device of each carburetor 124 includes a diaphragm pump 134 which is driven by pressure fluctuations in the associated crankcase chamber. The carburetors 124 desirably are arranged such that the pumps 134 lie on a side of the carburetors 126 opposite of the engine block 40. This arrangement provides a simplified piping layout, as described below. Conduits 136 thus connect the diaphragm pumps 134 with the associated crankcase chamber to convey pressure pulses within the chamber to the pump 134. The conduits connect to ports 138 formed on the outer sides of the pumps 134.

The diaphragm pump 134 draws fuel into a pump chamber through a check valve. The fuel is then metered through a second check valve through a second fuel line to a deliver chamber 140 located on the opposite side of the throttle throat 126. The pump 134 controls the movement of fuel in to and out of the pump chamber, in a known manner.

The rate at which fuel is delivered into the delivery chamber 140 is controlled, at least in part by a needle valve operated by a conventional throttle control. Fuel delivered to the delivery chamber 140 is subsequently introduced into the incoming air stream so as to create a fuel/air mixture. In particular, a diaphragm is mounted in the delivery chamber 140 and divides the chamber 140 into an atmospheric area and a fuel storage area. When the second check valve of the pump chamber closes, the diaphragm moves toward the throttle throat 126 to force the fuel through a delivery tube that open at the fuel opening in the venturi 132.

The fuel/air charge formed within the carburetor 124 is delivered to the corresponding crankcase chamber through an intake passage of an intake manifold 142. In the illustrated embodiment, the intake manifold 142 lies below the carburetors 124. Each intake passage of the intake manifold 142 communicates with the outlet of one of the carburetors 124.

The present fuel supply system delivers a continuous flow of fuel to the pump chamber of the diaphragm pump 134. For this purpose, the fuel supply system includes a fuel supply line 144 and a fuel return line 146. Both the fuel supply line 144 and the fuel return line 146 communicate with parallel branches of a fuel circuit that lie between the supply line 144 and the return line 146. The carburetors 124 are positioned within these parallel branches.

The branches desirably include supply segments that extend between a common junction and the carburetors, and return segments that extend between the carburetors and a common junction. In the illustrated embodiment, the common junctions are Tee fittings 148, 150 which interconnect the supply and return lines 144, 146 with the supply and return branch segments, respectively.

As best understood from FIGS. 4 and 5, the supply line 144 connects to the Tee fitting 148. A first supply segment 152 extends from the Tee fitting to a first carburetor 124, and a second supply segment 154 extends from the Tee fitting 148 to a second carburetor 124. The ends of the supply segments 152, 154 in particular connect to fuel inlet ports on the carburetors 124 which lead to the respective pump chambers of the diaphragm pump 134 through the associated first check valve (not shown).

The first and second supply segments 152, 154 desirably have about the same lengths and the flow axes through the segments 152, 154 generally lie within the same common plane. As understood from FIGS. 4 and 5, the common plane is generally horizontal. This layout of the supply segments 152, 154 promotes even flow resistances between the supply segments 152, 154.

As best seen in FIGS. 5 and 6, the return line 146 connects to the Tee fitting 150. A first return segment 156 extends from the first carburetor 124 to the Tee fitting 150, and a second return segment 158 extends from the second carburetor 126 to the Tee fitting 150. The upstream ends of the return segments 156, 158 in particular connect to excess fuel outlet ports on the carburetors 124 which communicate with the delivery tube between the pump chamber and the delivery chamber (not shown) within the carburetor 124.

The first and second return segments 156, 158 desirably have about the same lengths and the flow axes through the segments 156, 158 generally lie within the same common plane. As understood from FIGS. 4 and 5, the common plane is generally horizontal. This layout of the return segments 156,158 promotes even flow resistances between the return segments 156, 158.

In addition, as seen in FIGS. 4 and 5, the supply and return segments 152, 154, 156, 158 desirably are arranged to lie generally parallel to one another. The common planes of the supply and return segments lies therefore are substantially parallel. And, as view from the top, the return segments 156, 158 and the corresponding Tee fitting 150 lie directly on top of the supply segments 152, 154 and the corresponding Tee fitting 148. The configuration of the supply branches within the respective plane thus mirrors the configuration of the return branches within the respective plane.

This configuration of the branches of the fuel circuit promotes an even fuel pressure within each of the lines. That is, the fuel pressure within each line does not significantly vary from line to line. Consequently the fuel pressure within each carburetor is easier to set.

The flow resistance in the supply segments and the return segments that are connected to the respective carburetors also are approximately equal from carburetor to carburetor and the fuel amounts supplied to the cylinders are approximately even among the cylinders. The arrangement of the segments also does not interfere with other engine components and the routing of the fuel supply and return lines are simplified and compacted.

In addition, the arrangement of the carburetors in the parallel branches of the fuel circuit helps ease the adjustment of fuel pressure within each carburetor. The fuel line communicates with each carburetor independent of the other, with the carburetors arranged in parallel. Fuel supply and return occur at the same time in each carburetor. As a result of the separate fuel supply and return, fuel pressure from one carburetor does not affect the other carburetor. Fuel pressure in each individual carburetor therefore is easier to adjust.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A fuel circuit for an engine of a small watercraft comprising a fuel supply line communicating with a fuel source and extending into a plurality of parallel fuel circuit branches, a fuel return line communicating with each of the branches to return excess fuel to the fuel source, and a plurality of charge formers arranged in parallel with each charge former being positioned within one of the branches of the fuel circuit.

2. A fuel circuit as in claim 1, wherein a supply segment of each branch extends from the fuel supply line to the corresponding carburetor, and the supply segments of the branches are arranged such that the flow resistance within each supply segment is generally equal between the supply segments of the branches.

3. A fuel circuit as in claim 2, wherein the supply segments have generally equal lengths.

4. A fuel circuit as in claim 2, wherein flow axes through the supply segments generally lie within the same plane.

5. A fuel circuit as in claim 4, wherein the plane in which the flow axes of the supply segment lie is generally horizontal.

6. A fuel circuit as in claim 2, wherein a return segment of each branch extends from the corresponding carburetor and the fuel return line, and the return segments of the branches are arranged to produce generally equal flow resistances within each of the return segments.

7. A fuel circuit as in claim 6, wherein the return segments have generally equal lengths.

8. A fuel circuit as in claim 7, wherein the return segments of the branches have generally the same lengths as the lengths of the supply segments of the branches.

9. A fuel circuit as in claim 6, wherein flow axes through the return segments generally lie within the same plane.

10. A fuel circuit as in claim 9, wherein the plane in which the flow axes of the return segments lie is generally parallel to a plane in which flow axes of the supply segments lie.

11. A fuel circuit as in claim 1, wherein the charge formers are floatless-type carburetors.

12. A multi-cylinder engine for a small watercraft comprising an engine block assembly including a plurality of variable-volume chambers, an induction system positioned on the side of the engine block assembly and including a plurality of charge formers, each of which supplies a fuel/air charge to one of the variably volume chambers, and a fuel circuit comprising a fuel supply line and a fuel return line, the fuel supply and returns lines separately communicating with each charger former, independent from the other charge formers.

13. An engine as in claim 12, wherein the charge formers are floatless-type carburetors.

14. An engine as in claim 12, wherein the fuel supply line communicates with a plurality of supply branches that stem from a common junction with the fuel supply line, and the fuel return line communicates with a plurality of return branches which merge into a common junction coupled to the return line, each supply branch and each return branch communicates with one of the charge formers.

15. An engine as in claim 14, wherein the supply branches and the return branches are positioned on a side of the charger formers opposite of the engine block assembly.

16. An engine as in claim 14, wherein the supply branches are arranged to lie within a common horizontal plane and are positioned such that the distances between the common junction to the respective carburetor are approximately the same.

17. An engine as in claim 16, wherein the return branches are arranged to lie within a common horizontal plane, and are positioned such that the distances between the common junction with the fuel return line and the respective carburetor are approximately the same.

18. An engine as in claim 17, wherein the configuration of the supply branches within the respective plane mirrors the configuration of the return branches within the respective plane.

19. An engine comprising an engine block including at least one variable-volume chamber, a charge former communicating with the variable-volume chamber and having an intake passage, and a fuel pump which supplies fuel to the charge former, the fuel pump being driven by pressure changes occurring within the variable-volume chamber and being located on a side of the charge former opposite the engine block with the intake passage being located between the engine block and the fuel pump.

20. An engine as in claim 19 additionally comprising a second charge former which supplies a fuel/air charge to a second variable-volume chamber, and a fuel circuit supplying fuel to both charge formers, the fuel circuit including a fuel supply line and a fuel return line which each extend between a fuel source and the charge formers with the charge formers arranged in parallel within the fuel circuit.

* * * * *